US008105206B2

(12) United States Patent
Rindfleisch

(10) Patent No.: US 8,105,206 B2
(45) Date of Patent: Jan. 31, 2012

(54) EXERCISE MACHINE

(75) Inventor: Randy R Rindfleisch, Sheboygan, WI (US)

(73) Assignee: Crazy Train LLC, Austin, TX (US)

( * ) Notice: Subject to any disclaimer, the term of this patent is extended or adjusted under 35 U.S.C. 154(b) by 186 days.

(21) Appl. No.: 12/495,463

(22) Filed: Jun. 30, 2009

(65) Prior Publication Data

US 2010/0331144 A1 Dec. 30, 2010

(51) Int. Cl.
*A63B 21/00* (2006.01)

(52) U.S. Cl. ..... 482/6; 482/1; 482/8; 482/9

(58) Field of Classification Search ..... 434/247; 482/1–9, 51, 52, 900–902
See application file for complete search history.

(56) References Cited

U.S. PATENT DOCUMENTS

| | | | | |
|---|---|---|---|---|
| 5,476,428 | A | 12/1995 | Potash et al. | |
| 5,562,577 | A | 10/1996 | Nichols, Sr. | |
| 5,827,154 | A * | 10/1998 | Gill | 482/9 |
| 6,270,445 | B1 | 8/2001 | Dean, Jr. et al. | |
| 6,296,596 | B1 | 10/2001 | Alessandri et al. | |
| 6,471,624 | B1 | 10/2002 | Voris | |
| 6,716,144 | B1 | 4/2004 | Shifferaw | |
| 6,780,143 | B2 | 8/2004 | Copeland | |
| 6,939,272 | B1 | 9/2005 | Wu | |
| 7,004,890 | B2 | 2/2006 | Webb et al. | |
| 7,029,427 | B2 | 4/2006 | Vuurmans et al. | |
| 7,070,544 | B1 | 7/2006 | Rindfleisch | |
| 7,070,545 | B2 | 7/2006 | Lull et al. | |
| 7,115,080 | B2 | 10/2006 | Cockrill, Jr. et al. | |
| 7,220,221 | B2 | 5/2007 | Mosimann et al. | |
| 7,854,685 | B2 * | 12/2010 | Cole et al. | 482/5 |
| 2005/0143233 | A1 | 6/2005 | Shifferaw | |
| 2007/0149367 | A1 | 6/2007 | Thulin | |
| 2008/0015094 | A1 | 1/2008 | Casagrande | |
| 2010/0227739 | A1 * | 9/2010 | Cunningham | 482/52 |

* cited by examiner

*Primary Examiner* — Glenn Richman
(74) *Attorney, Agent, or Firm* — Brannen Law Office, LLC

(57) ABSTRACT

An exercise machine includes a frame including a first portion and a second portion positioned in a plane generally perpendicular to the first portion. A carriage assembly moves along a linear path parallel to the first portion. A drive unit is joined to the frame for movement the carriage assembly in a first direction and a second direction. The drive unit includes a motor, a ball screw joined to the motor, and at least one support bearing rotatably joined to the ball screw and joined to the carriage assembly for enabling the carriage to move along the linear path in response to the ball screw rotating. A first sensor activates the motor in a first mode to move the carriage in the first direction. A second sensor activates the motor in a second mode to move the carriage in the second direction.

19 Claims, 7 Drawing Sheets

EXERCISE MACHINE

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to exercise and rehabilitation machines. More particularly, the invention relates to an apparatus that is capable of producing and measuring 0-100% of maximum voluntary eccentric, concentric, and static muscular contractions of an individual while exercising or rehabilitating.

BACKGROUND OF THE INVENTION

The physiology of human muscles contracts in three distinct fashions. The first is by concentric or "positive" contraction in which the muscle encounters an external load that is light enough to enable the muscle to shorten while contracting. The second is for the muscle to encounter an external load that is too heavy for the contracting muscle to shorten against thus producing a static or "isometric" contraction producing no movement. The third is by an eccentric or "negative" contraction in which a muscle encounters an external load that is heavy enough to cause a lengthening of the muscle under contraction. It is a well-established and accepted fact among the medical and rehabilitation professions that muscles can produce force at a much higher magnitude in an isometric or static contraction versus a concentric or positive contraction. Also, muscles produce their highest levels of force during the performance of an eccentric or negative contraction. Since muscular strength increases in direct proportion to the amount of tension imposed upon the muscles, physiologists have proven conclusively that strength is produced to a much higher level and in less time with eccentric contractions versus conventional concentric and static contractions.

Furthermore, muscles achieve this higher level of force during eccentric contractions much more efficiently than during a comparable load under concentric contractions. This physiological fact has led to the realization among the medical profession that people who are neurologically impaired because of injury or surgery can still be rehabilitated back to health by eccentric contractions despite the fact that they are unable to perform concentric contractions. Numerous studies also show that the elderly population can achieve increased health benefits such as increased muscular strength and balance and can reduce the chance of injuries from falls. These benefits can be achieved despite the possibility of suffering from age or disease related cardiovascular and pulmonary conditions. Eccentric contractions produce the much desired benefits of strength building and injury prevention at a much lower metabolic cost than concentric or static contractions, thus imposing much less demand on the cardiovascular and pulmonary systems of the body. It is therefore an objective of the present invention to provide an apparatus that enables a user to perform eccentric contractions of the muscles.

Various types of equipment have been developed over the years in an attempt to address these concerns; however this equipment has met with little success. These types of equipment range from simple conventional barbells to prohibitively expensive hydraulics. These machines are generally limited to one particular muscle, requiring the purchase of a complete line of individual machines, which can be very expensive financially and can occupy a large amount of space. This also poses a problem with paraplegics as they have to move from one machine to the next, which is virtually impossible without the assistance of one or more therapists or trainers. This often times leads to a feeling of dependence and depression. This is also the cause of many injuries to therapists, trainers and patients alike annually.

With few exceptions, prior art exercise and rehabilitation machines have failed to recognize the obvious problems to be addressed, the differing force generating capabilities during concentric, static, and eccentric contractions. Almost all prior machines impose a single load that limits the ability of muscles to contract with a higher force when generating eccentric contractions because of the inability of the exercising or rehabilitating muscle to shorten under a significantly greater load so that a much stronger lengthening can occur.

Examples of prior devices are plentiful. The Nautilus Co. among others has employed the use of spiral cams in an attempt to accommodate the force curves that take place as muscles lengthen and leverage changes that occur during a concentric contraction. However, these devices have failed to address the much more obvious and important strength differences between concentric, static, and eccentric contractions. Another example of an exercising or rehabilitation machine uses a weight stack sliding vertically on guide rods. The weight on this type of machine can be changed between exercises; however, the weight remains constant during the exercises, severely limiting static and eccentric contractions. Another example of an exercising or rehabilitation machine employs the use of levers. Regardless of the amount of weight put on the machine, it remains constant and does not take into account the fact that muscles contract at three different force levels during any given movement of that muscle. Another example of an exercising or rehabilitation machine is a plate-loaded machine. The weight on this type of device may be changed between exercises. However, the weight remains constant throughout the concentric, static, and eccentric contractions of a particular exercise. There is also the option of traditional barbells. However, not only are barbells incapable of changing the amount of weight applied to the muscles in concentric, static, and eccentric contractions, they are in fact quite dangerous to all involved.

In view of the foregoing, there is a need for improved techniques for providing an exercising and rehabilitation apparatus that takes into account the differing force generating capabilities during concentric, static, and eccentric muscular contractions and is capable of producing and measuring 0-100% of maximum voluntary eccentric, concentric, and static muscular contractions of an individual while exercising or rehabilitating.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A shows the user at the start of a concentric contraction or at the end of an eccentric contraction, and FIG. 2B shows the user at the end of the concentric contraction or at the start of the eccentric contraction;

FIG. 3A shows the user at the start of a concentric contraction or at the end of an eccentric contraction, and FIG. 3B shows the user at the end of the concentric contraction or at the start of the eccentric contraction;

FIG. 5A shows the user at the start of a concentric contraction or at the end of an eccentric contraction, and FIG. 5B shows the user at the end of the concentric contraction or at the start of the eccentric contraction;

FIG. 6A shows the user at the start of a concentric contraction or at the end of an eccentric contraction, and FIG. 6B shows the user at the end of the concentric contraction or at the start of the eccentric contraction.

Figure 1:
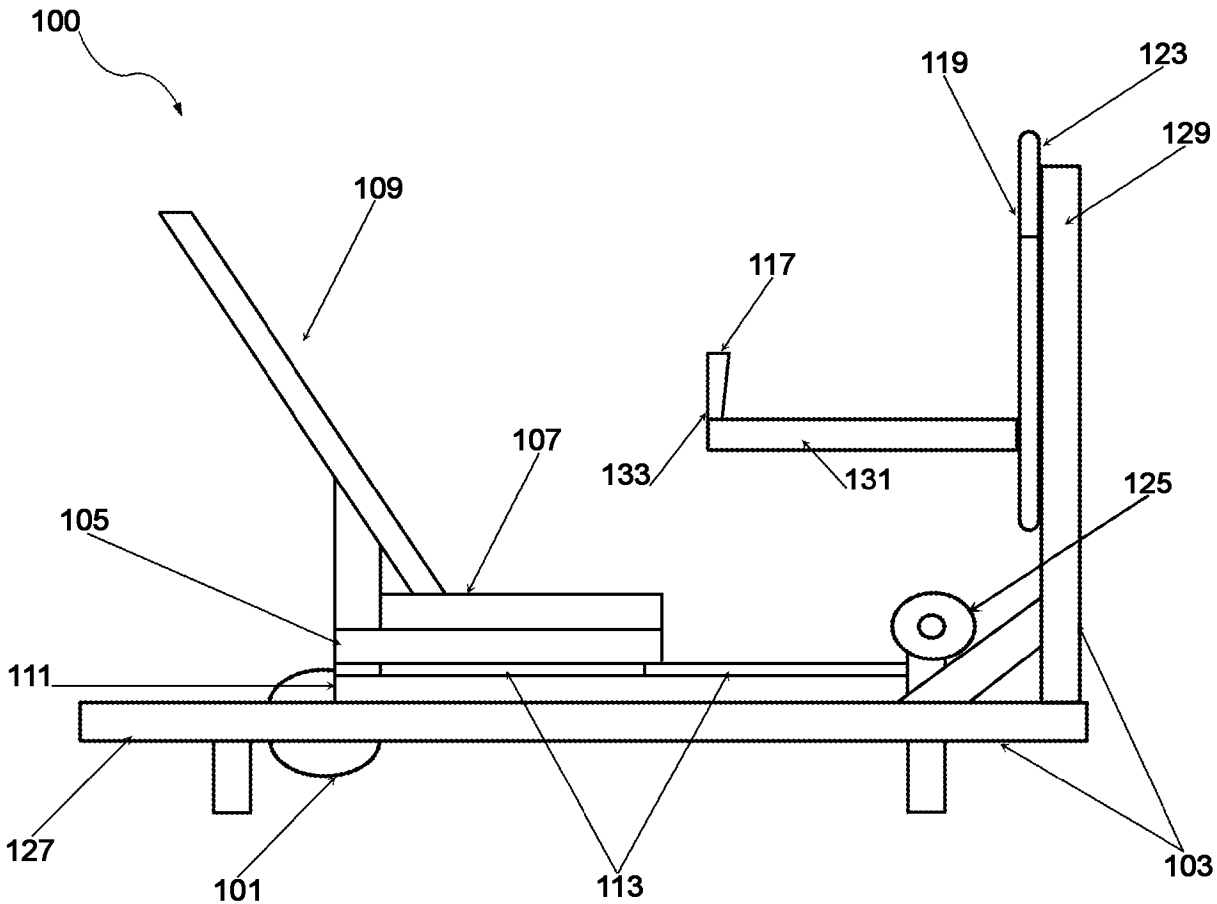
FIG. 1 is a diagrammatic side view of an exemplary exercise or rehabilitation machine with a horizontal carriage configuration, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an exercise machine is presented.

In one embodiment an exercise machine includes a frame including a first portion and a second portion positioned in a plane generally perpendicular to the first portion. A carriage assembly moves along a linear path parallel to the first portion. A drive unit is joined to the frame for movement the carriage assembly in a first direction and a second direction. The drive unit includes a motor, a ball screw joined to the motor, and at least one support bearing rotatably joined to the ball screw and joined to the carriage assembly for enabling the carriage to move along the linear path in response to the ball screw rotating. A first sensor activates the motor in a first mode to move the carriage in the first direction. A second sensor activates the motor in a second mode to move the carriage in the second direction. Another embodiment further includes a monitor unit including a display device joined to the frame for at least monitoring the first mode and the second mode of the motor. Yet another embodiment further includes a load cell joined to the frame and drive unit for indicating a resisting force to the carriage movement and transmitting the indication to the monitor unit for display. In another embodiment the monitor unit further includes means for adjusting the first mode and the second mode to control a speed of the movement of the carriage. In yet another embodiment the at least one support bearing further includes a ball nut for rotatably joining to the ball screw. Still other embodiments further include at least one linear rail for guiding the carriage along the linear path and at least one pillow block bearing joined to the carriage for travel along the linear rail. In another embodiment the exercise machine is wheelchair and paraplegic accessible. In yet another embodiment the first portion is oriented generally horizontally. In still another embodiment the first portion is oriented generally vertically.

In another embodiment an exercise machine includes a frame including a first portion and a second portion positioned in a plane generally perpendicular to the first portion. A carriage assembly moves along a linear path parallel to the first portion. The exercise machine further includes means for moving the carriage assembly in a first direction and a second direction along the linear path, means for activating the moving means in a first mode to move the carriage in the first direction and means for activating the moving means in a second mode to move the carriage in the second direction. Another embodiment further includes means for monitoring the first mode and the second mode of the motor. Yet another embodiment further includes means for indicating a resisting force to the carriage movement and transmitting the indication to the monitoring means. Still another embodiment further includes means for adjusting the first mode and the second mode to control a speed of the movement of the carriage. Yet another embodiment further includes means for guiding the carriage along the linear path.

In another embodiment an exercise machine includes a frame including a first portion, a second portion positioned in a plane generally perpendicular to the first portion, and linear rails parallel to the first portion. A carriage assembly moves along the linear rails. Pillow block bearings are joined to the carriage for travel along the linear rails. A drive unit is joined to the frame for movement the carriage assembly in a first direction and a second direction. The drive unit includes a motor, a ball screw joined to the motor, and at least one support bearing including a ball nut for rotatably joining to the ball screw. The support bearing is joined to the carriage assembly for enabling the carriage to move along the linear rails in response to the ball screw rotating. A first sensor activates the motor in a first mode to move the carriage in the first direction. A second sensor activates the motor in a second mode to move the carriage in the second direction. A monitor unit, including a display device joined to the frame, at least monitors the first mode and the second mode of the motor. The monitor unit includes means for adjusting the first mode and the second mode to control a speed of the movement of the carriage. A load cell is joined to the frame and the drive unit for indicating a resisting force to the carriage movement and for transmitting the indication to the monitor unit for display on the display device. In another embodiment the motor includes a gear reduction box. In yet another embodiment the exercise machine is wheelchair and paraplegic accessible. In still another embodiment the first portion is oriented generally horizontally. In yet another embodiment the first portion is oriented generally vertically.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide exercise or rehabilitation machines that enable a user to produce 0-100% of their potential force while performing concentric, eccentric and static muscular contractions. Preferred embodiments of the present invention comprise a motor-driven, gearbox-reduced ball screw assembly that enhances the efficiency of muscle strength building or rehabilitation. In preferred embodiments, the motor-driven, gearbox-reduced ball screw travels at a desired adjustable speed, enabling a client or patient to push or pull using the desired muscles in a linear closed kinetic chain fashion at 0-100% of their potential force of concentric, static, and eccentric contractions. Preferred embodiments also comprise a real time force gauge on a touch screen that enables the user to see exactly how much force they are producing throughout the entire range of motion during concentric, static, and eccentric contractions for any given muscle. Patients and clients as well as therapists and trainers will be able to determine in real time if the patient or client is applying the prescribed amount of force desired for that session based on previous static testing on the same machine. As the level of strength and neurological progress increases with the patient or client using a preferred embodiment, the percentage of concentric, static, and eccentric contractions can progress in a safe and comfortable manner until 100% functional ability is achieved.

In preferred embodiments, an exercise or rehabilitation machine comprises a frame that rests on the floor. A hollow shaft, gearbox-reduced electric motor with a variable speed drive is connected to a ball screw assembly which includes a force sensor attached to the other end of the frame by tapered bearings enclosed in housings. In preferred embodiments, the ball screw assembly has either a vertical or horizontal carriage connected to four pillow block bearings that travel either vertically or horizontally along linear rails. Movement either vertically or horizontally is initiated by touchless sensors located on the ends of handles connected to the carriage in a vertical configuration or a footplate in a horizontal configuration. In preferred embodiments, left sensors move the carriage forward in the horizontal configuration or up in the vertical configuration, and right sensors move the carriage backward in the horizontal configuration or down in the vertical configuration. However, the left and right sensors may be reversed in alternate embodiments. In preferred embodiments, limit switches at opposite ends of the linear rails, both vertically and horizontally, prevent the carriage from traveling beyond the desired range of motion. In preferred embodiments, the force sensor and variable drive are connected to a touch screen mounted to the top of the footplate on the horizontal configuration and a vertical post on the vertical configuration. A seat for the exercising or rehabilitating person is attached to the frame in the vertical configuration and attached to the carriage in the horizontal configuration. Preferred embodiments enable the seat, footplate, roller pads, handles, and carriages to be located relative to each other to enable a person to exercise or rehabilitate a particular set of muscles.

In typical use of a preferred embodiment, an exercising person places himself in the appropriate position on the machine's seat and/or footplate. The user contacts the handles, footplate, seat, or carriage with the appropriate part of the body and then activates the carriage, vertically or horizontally, by placing a thumb over the appropriate touchless sensor. The user exerts force with the appropriate muscles in a concentric contraction until the desired range of motion has been achieved. At the end of the concentric contraction the user removes their thumb from the sensor and places a thumb over the opposite sensor to activate the carriage, vertically or horizontally, in the opposite direction. The user exerts force with the same muscles in an eccentric contraction until the desired range of motion has been achieved. The user then repeats this cycle for as many repetitions as desired. The amount of power generated by the electric motor in preferred embodiments far exceeds a user's force generating ability, thus enabling the individual to exert 0-100% of his pre-determined ability in concentric, static, and eccentric contractions generally in safety and comfort. The method and apparatus of preferred embodiments of the present invention, a gearbox-reduced, variable speed driven electric motor and ball screw assembly, greatly increases the efficiency of exercise and rehabilitation sessions. Furthermore, it is generally assumed by some that only healthy, mobile people will be able to exercise or rehabilitate on preferred embodiments of the present invention. However, both vertical and horizontal embodiments are wheelchair and paraplegic accessible.

Preferred embodiments of the present invention are adaptable to exercising virtually all muscles of the body. In a preferred vertical embodiment of the present invention, the machine enables a person to perform exercises including but not limited to the following: squats, dead lifts, calf raises, abdominal crunches, pull-downs, presses, dips, rows, shrugs, etc. In a preferred horizontal embodiment of the present invention, the machine enables a person to perform exercises including, but not limited to, the following: leg presses, leg curls, calf raises, bench presses, rows, abdominal crunches, etc. Vertical and horizontal embodiments of the present invention preferably have the same basic frame and motor, ball screw assembly. In these preferred embodiments, only the movement of the carriage varies between the vertical and the horizontal configurations to suit the particular exercise to be performed. However, in alternate embodiments frames and motor assemblies may be created specifically for a vertical or a horizontal configuration. In both vertical and horizontal embodiments of the present invention, the same laws of physics and physiology apply.

FIG. 1 is a diagrammatic side view of an exemplary exercise or rehabilitation machine 100 with a horizontal carriage configuration, in accordance with an embodiment of the present invention. In the present embodiment, exercise machine 100 comprises a gear-reduced ball screw assembly driven by an electric motor 101. Exercise machine 100 is in a horizontal configuration; however, it will be readily understood by those skilled in the art that alternate embodiments of the present invention are not limited to a horizontal configuration for exercising any specific human muscles. On the contrary, various different embodiments may be useful for exercising a wide variety of muscles.

Exercise machine 100 comprises a frame 103, electric motor 101, the gear-reduced ball screw assembly including support bearing 135, a bearing housing and tapered bearings, a horizontal carriage 105 with a seat 107 and a backrest 109, linear rails 111, pillow blocks 113, front and rear limit switches (not shown), forward and reverse sensors 117, a footplate 119, a load cell (not shown), a force display and speed control touch screen 123, and roller pads 125. In the present embodiment, frame 103 is constructed with two parallel, horizontal metal beams 127 fixed to three cross braces (not shown) and one upright metal beam 129, which is fixed in a perpendicular position to the forward most cross brace. Those skilled in the art, in light of the present teachings, will readily recognize that frames in alternate embodiments may be assembled in a multiplicity of different configurations and may be made of various different materials such as, but not limited to, wood, plastics, composite materials, etc. In the present embodiment, footplate 119 is fixed to upright beam 129 as well as touch screen 123, which is fixed to upright beam 129 above foot plate 119. Two horizontal handles 131 are attached to footplate 119, and a round tube 133 is fixed vertically to each horizontal handle 131. Handles 131 are located on the left and right side of footplate 119 in front of horizontal carriage 105. In some embodiments the tubes may be attached to the horizontal handles in a removable fashion so that users can interchange tubes of different sizes for increased comfort when performing different exercises and to accommodate users with different hand sizes. In the present embodiment, horizontal carriage 105 is attached to four pillow block bearings 113, and pillow block bearings 113 are attached to two linear rails 111. Linear rails 111 are fixed to two horizontal metal beams 127. Horizontal carriage 105 is attached to support bearings 135 which travel upon the command of sensors 117 along the ball screw which is inserted into a gear reduction box which is attached to electric motor 101. Electric motor 101 comprises a variable speed drive and is located on the rear metal cross brace between horizontal beams 127. The ball screw mechanism is attached to two tapered bearings enclosed in a bearing housing which is fixed to the load cell. The load cell is fixed to the forward most metal cross brace between horizontal beams 127. Two limit switches are located at opposite ends of linear rails 111 fixed to the inside of one of horizontal metal beams 127 to automatically stop movement of horizontal carriage 105 when horizontal carriage 105 reaches the limits of the desired range of motion.

In typical use of the present embodiment, a user sits on horizontal carriage 105, places their feet on footplate 119 or roller pads 125, grabs tubes 133 on handles 131, and places a thumb over one of sensors 117. Placing a thumb over a sensor 117 activates the variable speed control which activates electric motor 101 which then causes the ball screw to rotate causing support bearings 135 to travel along the ball screw in a linear fashion. Since horizontal carriage 105 is fixed to pillow blocks 113 that are fixed to linear rails 111, horizontal carriage 105 travels in the direction determined by the sensor on which the user has their thumb, either away from footplate 119 if the reverse sensor is covered or toward footplate 119 if the forward sensor is covered, until the user lifts their thumb off of sensor 117 or horizontal carriage 105 reaches the rear or front limit switch. While horizontal carriage 105 is moving, the user exerts force on footplate 119 and/or pushes or pulls on tubes 133 to perform a concentric muscular contraction or an eccentric muscular contraction depending on the position of the user's body and the direction of the movement of horizontal carriage 105. Touch screen 123 enables the user to see how much force he is exerting throughout the exercise and also enables the user to change the speed of the movement of horizontal carriage 105. In alternate embodiments the force display may not be a touch screen. These embodiments may comprise buttons separate from the force display to control the speed of the horizontal carriage.

Figure 2A:
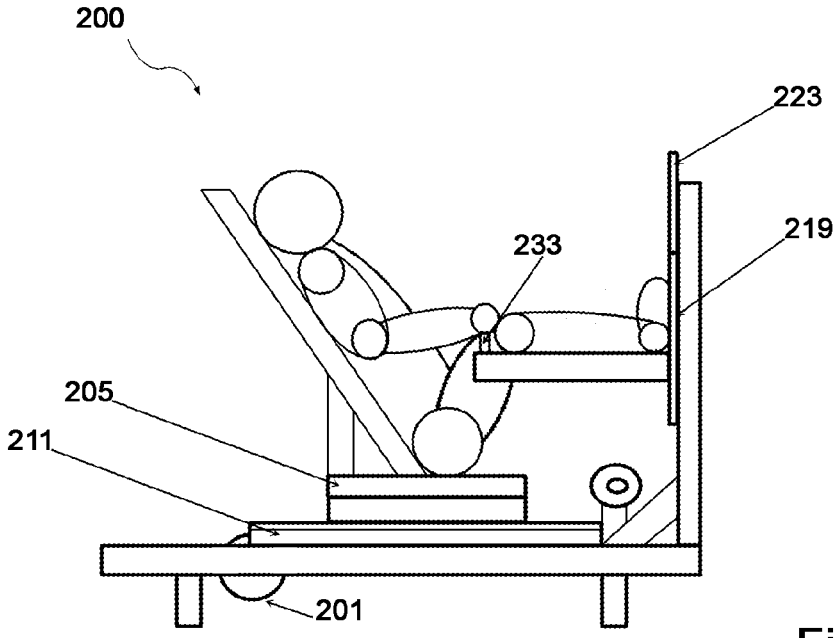
FIGS. 2A and 2B are diagrammatic side views of a user performing a leg press, a bench press or a rowing exercise on an exemplary exercise or rehabilitation machine with a horizontal carriage configuration, in accordance with an embodiment of the present invention.
Figure 2B:
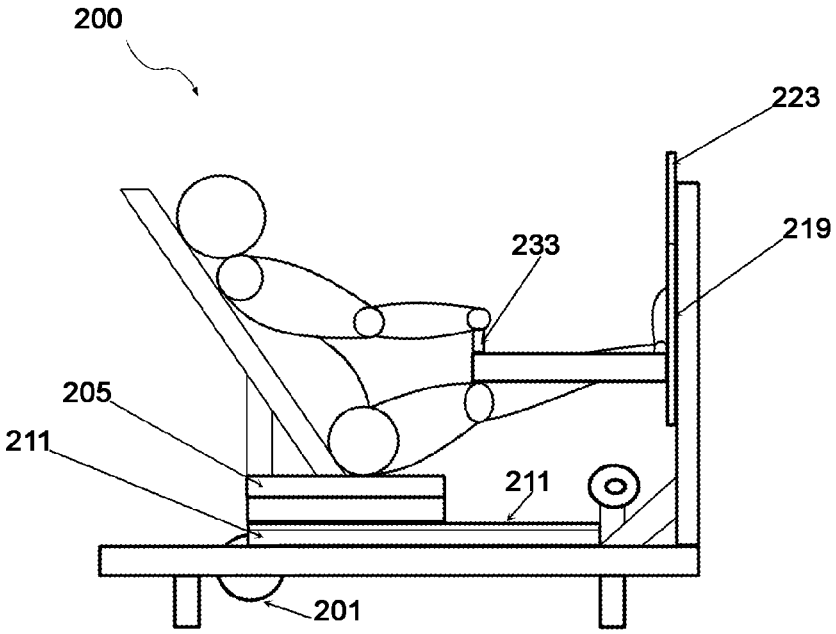

FIGS. 2A and 2B are diagrammatic side views of a user performing a leg press, a bench press or a rowing exercise on an exemplary exercise or rehabilitation machine 200 with a horizontal carriage configuration, in accordance with an embodiment of the present invention. FIG. 2A shows the user at the start of a concentric contraction or at the end of an eccentric contraction, and FIG. 2B shows the user at the end of the concentric contraction or at the start of the eccentric contraction. To perform a leg press, a bench press or a row, the user sits on a horizontal carriage 205, places their feet on a footplate 219 and grabs tubes 233. Placing a thumb over a forward or reverse sensor at tubes 233 activates a variable speed drive which activates an electric motor 201 and a ball screw mechanism coupled to motor 201. This causes horizontal carriage 205 to travel along linear rails 211 in a horizontal motion. Referring to FIG. 2A, for a leg press or bench press, the user exerts force on footplate 219 with his legs while covering the reverse sensor to move horizontal carriage 205 away from footplate 219 to perform a concentric contraction. Then, referring to FIG. 2B, when the user's legs are extended, the user releases the reverse sensor and places a thumb over the forward sensor, which causes horizontal carriage 205 to move towards footplate 219 while the user continues to exert force on footplate 219 with his legs allowing the user to perform an eccentric leg press or bench press. The user may then release the forward sensor and cover the reverse sensor to repeat the concentric contraction. The user can monitor his force production throughout the various stages of the exercise by looking at a force display 223. The actions to perform a rowing exercise are the same as those for performing a leg press or a bench press except that the user pulls or pushes on tubes 133 with his arms, depending on the direction in which horizontal carriage 205 is moving, rather than exerting force on footplate 219 with his legs.

Figure 3A:
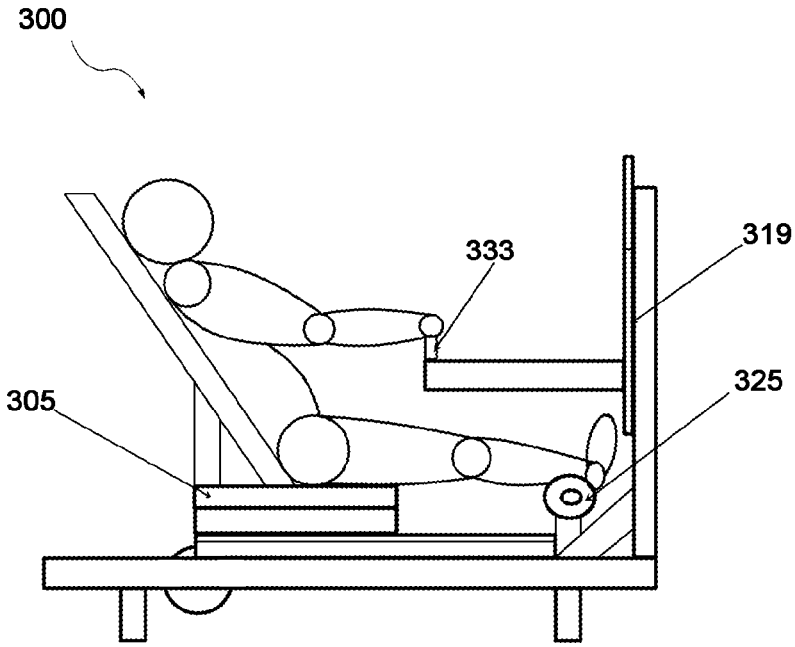
FIGS. 3A and 3B are diagrammatic side views of a user performing a leg curl on an exemplary exercise or rehabilitation machine with a horizontal carriage configuration, in accordance with an embodiment of the present invention.
Figure 3B:
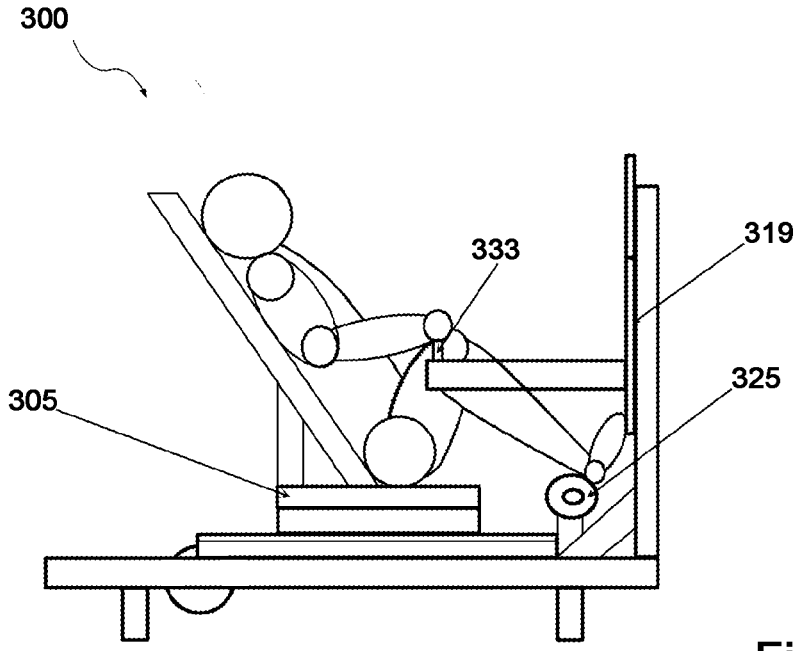

FIGS. 3A and 3B are diagrammatic side views of a user performing a leg curl on an exemplary exercise or rehabilitation machine 300 with a horizontal carriage configuration, in accordance with an embodiment of the present invention. FIG. 3A shows the user at the start of a concentric contraction or at the end of an eccentric contraction, and FIG. 3B shows the user at the end of the concentric contraction or at the start of the eccentric contraction. To perform a leg curl, the user sits on a horizontal carriage 305 and places his heels on roller pads 325. The user then presses his heels into roller pads 325 while controlling the movement of horizontal carriage 305 with forward and reverse sensors at tubes 333. The concentric contraction is performed while horizontal carriage 305 is moving toward a footplate 319, and the eccentric contraction is performed while horizontal carriage 305 is moving away from footplate 319.

Those skilled in the art, in light of the present teachings, will readily recognize that a multiplicity of alternate exercises may be performed on exercise and rehabilitation machines with horizontal carriage configurations in accordance with preferred embodiments of the present invention such as, but not limited to, calf raises, abdominal crunches, etc.

Figure 4:
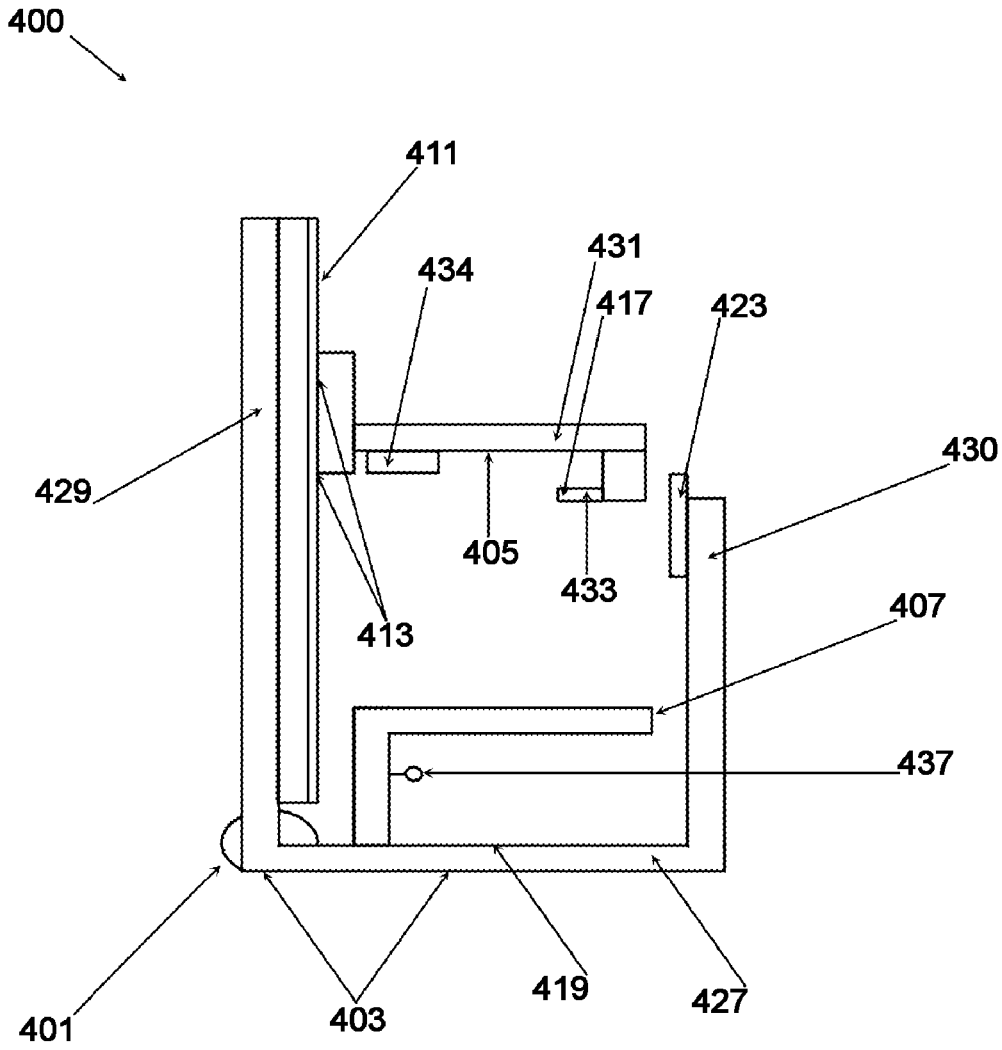
FIG. 4 is a diagrammatic side view of an exemplary exercise or rehabilitation machine with a vertical carriage configuration, in accordance with an embodiment of the present invention.

FIG. 4 is a diagrammatic side view of an exemplary exercise or rehabilitation machine 400 with a vertical carriage configuration, in accordance with an embodiment of the present invention. In the present embodiment, exercise machine 400 comprises a gearbox-reduced ball screw assembly driven by an electric motor 401. Exercise machine 400 is in a vertical configuration; however, it will be understood by those skilled in the art that alternate embodiments of the present are not limited to a vertical configuration for exercising or rehabilitating specific human muscles. On the contrary, various different embodiments of the present invention may be useful for exercising a wide variety of muscles.

Exercise machine 400 comprises a frame 403, electric motor 401, the gearbox-reduced, variable speed drive ball screw assembly including support bearings 435 [, a bearing housing and tapered bearings, Exercise machine 400 also comprises a vertical carriage 405, linear rails 411, pillow blocks 413, top and bottom limit switches (not shown), up and down sensors 417, a footplate 419, a load cell (not shown), a digital force display and speed control touch screen 423, and a vertically adjustable seat 407. In the present embodiment, frame 403 comprises two horizontal metal beams 427 fixed to three cross braces (not shown) and two upright metal beams 429 fixed to one cross brace (not shown) near the top of upright beams 429. Upright beams 429 are fixed to horizontal beams 427 perpendicularly. A vertical metal beam 430 is fixed perpendicularly to the center of the forward most cross brace between horizontal beams 427. Those skilled in the art, in light of the present teachings, will readily recognize that frames in alternate embodiments may be assembled in a multiplicity of different configurations and may be made of various different materials such as, but not limited to, wood, plastics, etc. In the present embodiment, footplate 419 is attached to horizontal beams 427, and touch screen 423 is attached to vertical beam 430. Two horizontal handles 431 are attached to vertical carriage 405, and a round tube 433 is attached to each of horizontal handles 431. Alternate embodiments may comprise a second set of tubes on the upper side of the horizontal handles, as shown by way of example in FIGS. 6A and 6B, to enable the user to perform a wider variety of exercises. In some embodiments the tubes may be attached to the horizontal handles in a removable fashion so that users can interchange tubes of different sizes for increased comfort when performing different exercises and to accommodate users with different hand sizes. In the present embodiment, a shoulder pad 434 is attached to each horizontal handle 431 for user comfort.

Vertical carriage 405 is attached to four pillow block bearings 413, and pillow block bearings 413 are attached to two linear rails 411. Linear rails 411 are fixed to upright beams 429. Vertical carriage 405 is fixed to support bearings 435 which travel upon the command of up and down sensors 417 along the ball screw. The ball screw is inserted into a gear reduction box which is attached to electric motor 401. Electric motor 401 is fixed to a variable speed drive near a bottom rear cross brace. The ball screw is fixed to two tapered bearings enclosed in a bearing housing which is fixed to the load cell. In the present embodiment, the load cell is fixed to the top most cross brace between upright beams 429. Two limit switches are located at opposite ends of linear rails 411 and fixed to the inside of an upright beam 429 to automatically stop movement of vertical carriage 405 when vertical carriage 405 reaches the limits of the desired range of motion. Vertically adjustable seat 407 is fixed to a center cross brace between horizontal beams 427. In the present embodiment seat 407 is vertically adjusted by means of a spring-loaded pin 437. However, the seat in alternate embodiments may be adjusted using various different means such as, but not limited to, a crank, a series of holes into which a pin slides, [ etc.

In typical use of the present embodiment, a user places their feet on footplate 419 and grabs tubes 433 on handles 431. For some exercises, such as, but not limited to, dips or dead lifts, seat 407 may be removed so that it is not in the way of the movement of the user, and in other exercises such as, but not limited to, pull downs or presses the user sits on seat 407 to correctly perform the exercise. Once the user is in the correct position for the particular exercise, the user places a thumb over one of sensors 417. Placing a thumb over a sensor 417 activates the variable speed control which activates electric motor 401 which then causes the ball screw to rotate causing support bearings 435 to travel along the ball screw in a linear fashion. Since vertical carriage 405 is fixed to pillow blocks 413 that are fixed to linear rails 411, vertical carriage 405 travels along linear rails 411 in the direction determined by the sensor 417 on which the user has their thumb, either up if the up sensor is covered or down if the down sensor is covered, until the user removes their thumb from sensor 417 or vertical carriage 405 reaches the top or bottom limit switch. While vertical carriage 405 is moving, the user exerts force on footplate 419 and/or pushes or pulls on tubes 433 to perform a concentric muscular contraction or an eccentric muscular contraction depending on the position of the user's body and the direction of the movement of vertical carriage 405. Touch screen 423 enables the user to see how much force he is exerting throughout the exercise and also enables the user to change the speed of the movement of vertical carriage 405. In alternate embodiments the force display may not be a touch screen. These embodiments may comprise buttons separate from the force display to control the speed of the vertical carriage.

Figure 5A:
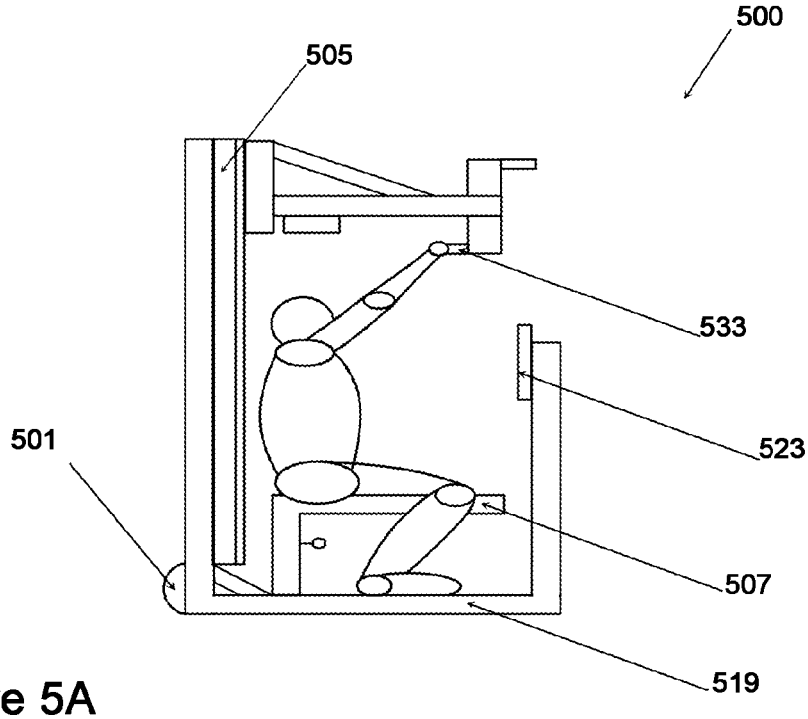
FIGS. 5A and 5B are diagrammatic side views of a user performing a pull-down on an exemplary exercise or rehabilitation machine with a vertical carriage configuration, in accordance with an embodiment of the present invention.
Figure 5B:
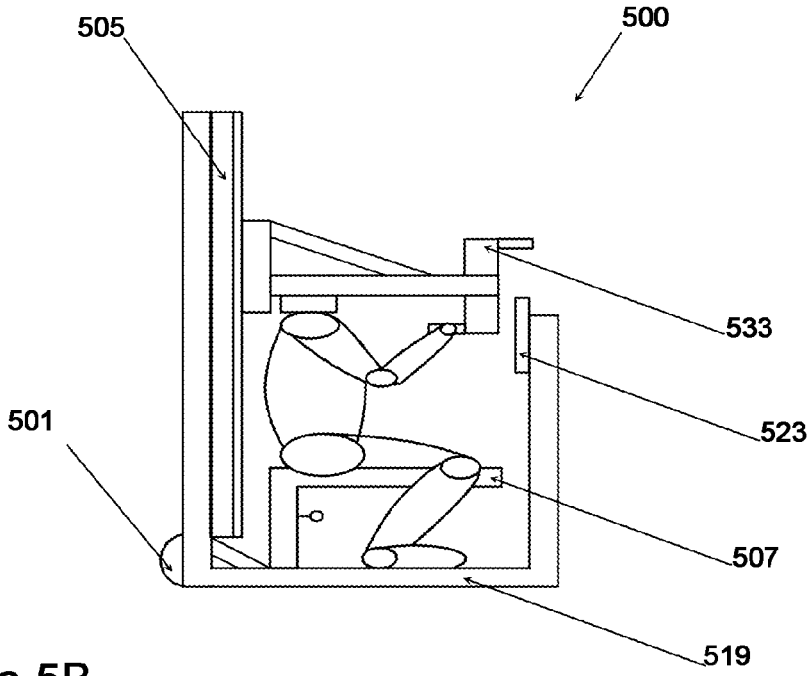

FIGS. 5A and 5B are diagrammatic side views of a user performing a pull-down on an exemplary exercise or rehabilitation machine 500 with a vertical carriage configuration, in accordance with an embodiment of the present invention. FIG. 5A shows the user at the start of a concentric contraction or at the end of an eccentric contraction, and FIG. 5B shows the user at the end of the concentric contraction or at the start of the eccentric contraction. To perform the pull-down, the user sits on an adjustable seat 507, places his feet on a footplate 519, fastens a seatbelt attached to seat 407, and grabs tubes 533. The user places a thumb over sensors at tubes 533 to move a vertical carriage 505 in the desired direction, up or down. While vertical carriage 505 is moving, the user pulls down on tubes 533 to perform the pull-down. Referring to FIG. 5A, the user places a thumb over the down sensor which activates a variable speed drive which activates an electric motor 501 which then causes a ball screw assembly to rotate causing support bearings to travel along the ball screw in a linear fashion. Since vertical carriage 505 is fixed to linear rails 511, vertical carriage 505 travels in a downward direction along linear rails 511 towards the user until the user lifts his thumb off of the down sensor or vertical carriage 505 reaches the bottom limit switch. This action enables the user to perform a concentric pull-down exercise. Referring to FIG. 5B, once the user reaches the end of the concentric pull-down, the user places a thumb over the up sensor to reverse the movement of vertical carriage 505 so that vertical carriage 505 travels in an upward direction away from the user until the user lifts the thumb off of the up sensor or vertical carriage 505 reaches the top limit switch. This action enables the user to perform an eccentric pull-down exercise. The user may then release the up sensor and cover the down sensor to repeat the concentric contraction. The user can monitor his force production throughout the various stages of the exercise by looking at a force display 523.

By pressing up on tubes 533 rather than pulling down on tubes 533 the user can perform a press while in this position on exercise machine 500. Referring to FIG. 5B, the user performs the concentric contraction by placing a thumb over the up sensor to move vertical carriage 505 upward, and, referring to FIG. 5A, the user performs the eccentric contraction by placing a thumb over the down sensor to move vertical carriage 505 downward.

Figure 6A:
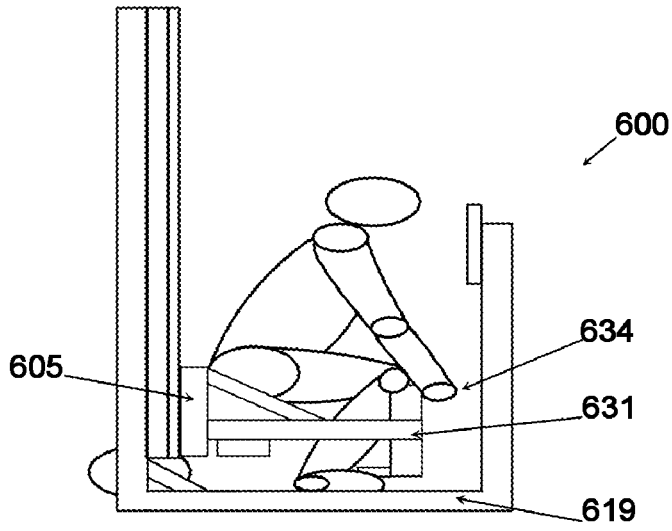
FIGS. 6A and 6B are diagrammatic side views of a user performing a dead lift on an exemplary exercise or rehabilitation machine with a vertical carriage configuration, in accordance with an embodiment of the present invention.
Figure 6B:
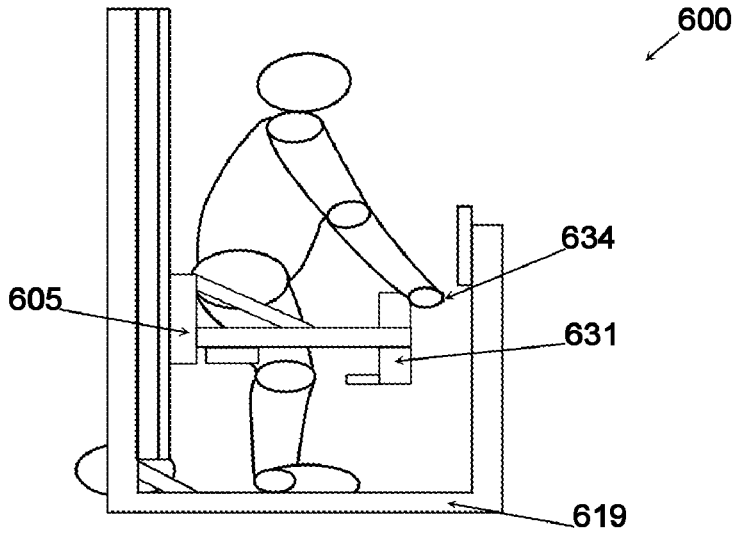

FIGS. 6A and 6B are diagrammatic side views of a user performing a dead lift on an exemplary exercise or rehabilitation machine 600 with a vertical carriage configuration, in accordance with an embodiment of the present invention. FIG. 6A shows the user at the start of a concentric contraction or at the end of an eccentric contraction, and FIG. 6B shows the user at the end of the concentric contraction or at the start of the eccentric contraction. In the present embodiment, exercise machine 600 comprises a second set of tubes 634 on the top side of horizontal handles 631. To perform a dead lift, the user stands on a footplate 619 and grabs tubes 634. The user then presses his feet into footplate 619 while controlling the movement of a vertical carriage 605 with up and down sensors at tubes 634. The concentric contraction is performed while vertical carriage 605 is moving upward, and the eccentric contraction is performed while vertical carriage 605 is moving downward.

Those skilled in the art, in light of the present teachings, will readily recognize that a multiplicity of alternate exercises may be performed on exercise and rehabilitation machines with vertical carriage configurations in accordance with preferred embodiments of the present invention such as, but not limited to, dips, squats, calf raises, abdominal crunches, rows, shrugs, etc.

Figure 7:
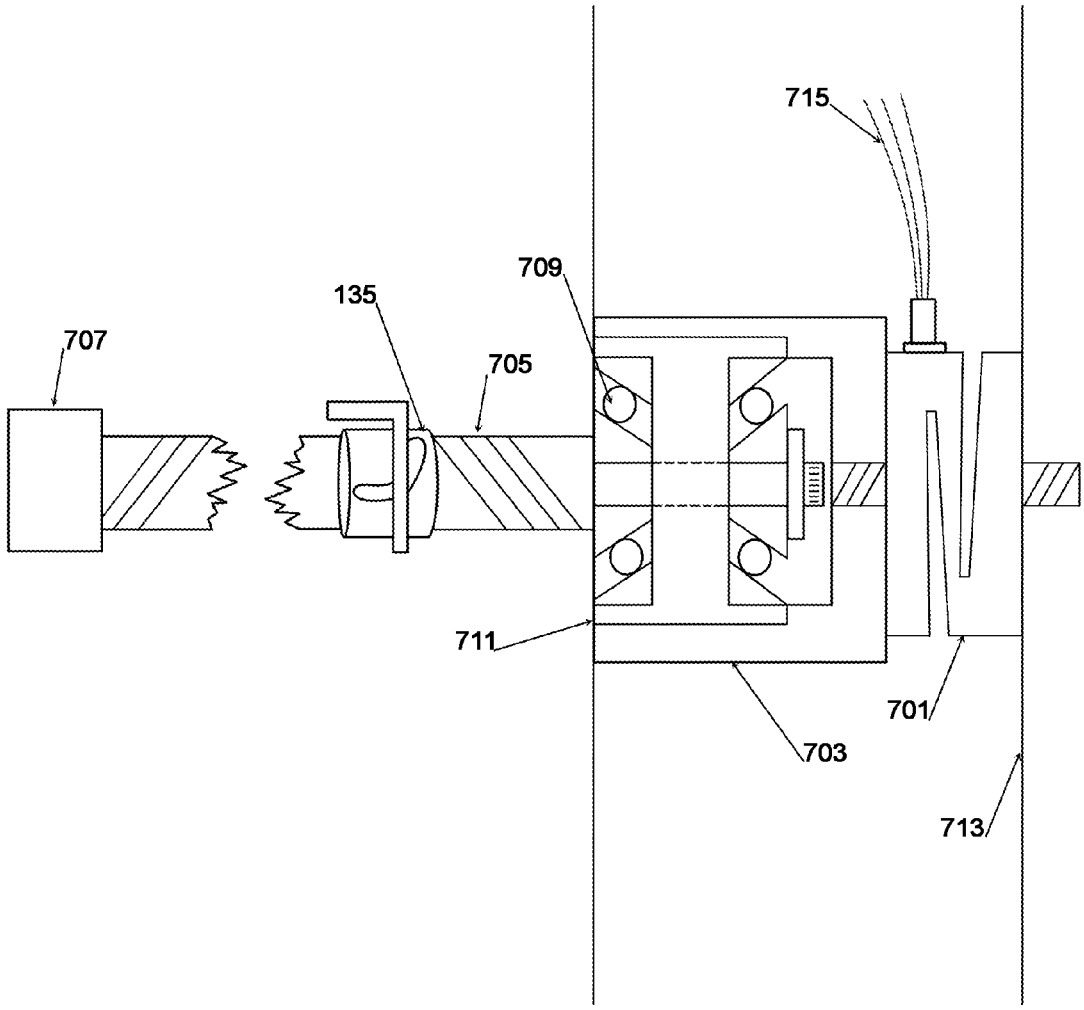
FIG. 7 is a diagrammatic top view of an exemplary load cell assembly from an exercise and rehabilitation machine, in accordance with an embodiment of the present invention.

FIG. 7 is a diagrammatic side view of an exemplary load cell assembly from an exercise and rehabilitation machine, in accordance with an embodiment of the present invention. In the present embodiment, the load cell assembly comprises a load cell 701, a load cell adaptor 703, a ball screw 705, and a motor 707 with a gear reduction box. Ball screw 705 is attached to two tapered bearings 709 enclosed in a bearing housing 711 which is fixed to load cell adaptor 703. Load cell 701 is fixed to a frame 713 of the exercise machine. In the present embodiment, ball screw 705 is joined to two tapered bearings 709 enclosed in a bearing housing 71 land ball nut 135 travel along the screw. Load cell 701 is preferably attached to frame 713 at the forward most cross brace between the horizontal beams in an exercise machine with a horizontal configuration, shown by way of example in FIG. 1, or to the top most cross brace between the vertical beams in an exercise machine with a vertical configuration, shown by way of example in FIG. 4. Those skilled in the art, in light of the present teachings, will readily recognize that the load cell may be located in various different locations in alternate embodiments. For example, without limitation, in an alternate embodiment with a horizontal configuration the load cell may be located behind the footplate. In an alternate embodiment with a vertical configuration, the load cell may be located under the footplate or under the seat. In these embodiments the load cell must take into account the weight of the user to accurately calculate the force. In the present embodiment when a user exerts force on the exercise machine, this force is translated through frame 713 to load cell 701. Load cell 701 then sends this information through wires 715 to a force display, for example, without limitation, touch screens 123 and 423 shown by way of example in FIGS. 1 and 4, respectively.

Having fully described at least one embodiment of the present invention, other equivalent or alternative methods of providing an exercise and rehabilitation machine that enables a user to produce 0-100% of their potential force while performing concentric, eccentric and static muscular contractions according to the present invention will be apparent to those skilled in the art. The invention has been described above by way of illustration, and the specific embodiments disclosed are not intended to limit the invention to the particular forms disclosed. For example, the particular implementation of the frame may vary depending upon the particular configuration of the carriage. The carriages described in the foregoing were directed to horizontal or vertical implementations; however, similar techniques are to provide frames with various different configurations such as, but not limited to, inclined or curved configurations. Implementations of the present invention with various different configurations are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An exercise machine allowing a user to apply a user force upon said exercise machine to perform an exercise, said exercise machine comprising:

a frame comprising a first portion and a second portion positioned in a plane generally perpendicular to said first portion;

a carriage assembly for movement along a linear path parallel to said first portion;

a drive unit joined to said frame for movement said carriage assembly in a first direction and a second direction, said drive unit comprising a motor;

a first motor activation sensor sensing a user input that is independent of said user force applied upon said exercise machine to perform an exercise for activating said motor in a first mode to move said carriage in said first direction; and a second motor activation sensor sensing a user input that is independent of said user force applied upon said exercise machine to perform an exercise for activating said motor in a second mode to move said carriage in said second direction.

2. The exercise machine as recited in claim 1, further comprising a monitor unit comprising a display device joined to said frame for at least monitoring said first mode and said second mode of said motor.

3. The exercise machine as recited in claim 2, further comprising a load cell joined to said frame and drive unit for indicating a resisting force to said carriage movement and transmitting said indication to said monitor unit for display.

4. The exercise machine as recited in claim 2, wherein said monitor unit further comprises means for adjusting said first mode and said second mode to control a speed of said movement of said carriage.

5. The exercise machine as recited in claim 1, further comprising at least one linear rail for guiding said carriage along said linear path.

6. The exercise machine as recited in claim 5, further comprising at least one pillow block bearing joined to said carriage for travel along said linear rail.

7. The exercise machine as recited in claim 1, wherein the exercise machine is wheelchair and paraplegic accessible.

8. The exercise machine as recited in claim 1, wherein said first portion is oriented generally horizontally.

9. The exercise machine as recited in claim 1, wherein said first portion is oriented generally vertically.

10. An exercise machine allowing a user to apply a weight lifting force upon said exercise machine, said exercise machine comprising:

a frame comprising a first portion and a second portion positioned in a plane generally perpendicular to said first portion;

a carriage assembly for movement along a linear path parallel to said first portion;

means for moving said carriage assembly in a first direction and a second direction along said linear path;

means for activating said moving means in a first mode to move said carriage in said first direction, said means for activating said moving means to move said carriage in said first direction sensing a user input that is independent of a weight lifting force; and means for activating said moving means in a second mode to move said carriage in said second direction, said means for activating said moving means to move said carriage in said second direction sensing a user input that is independent of a weight lifting force.

11. The exercise machine as recited in claim 10, further comprising means for monitoring said first mode and said second mode of said motor.

12. The exercise machine as recited in claim 11, further comprising means for indicating a resisting force to said carriage movement and transmitting said indication to said monitoring means.

13. The exercise machine as recited in claim 11, further comprises means for adjusting said first mode and said second mode to control a speed of said movement of said carriage.

14. The exercise machine as recited in claim 10, further comprising means for guiding said carriage along said linear path.

15. An exercise machine allowing a user to apply a weight lifting force upon said exercise machine, said exercise machine comprising:

a frame comprising a first portion, a second portion positioned in a plane generally perpendicular to said first portion, and linear rails parallel to said first portion;

a carriage assembly for movement along said linear rails;

pillow block bearing joined to said carriage for travel along said linear rails;

a drive unit joined to said frame for movement said carriage assembly in a first direction and a second direction, said drive unit comprising a motor, a ball screw joined to said motor, and at least one support bearing comprising a ball nut for rotatably joining to said ball screw, said support bearing being joined to said carriage assembly for enabling said carriage to move along said linear rails in response to said ball screw rotating;

a first motor activation sensor sensing a user input that is independent of said weight lifting force applied upon said exercise machine for activating said motor in a first mode to move said carriage in said first direction;

a second motor activation sensor sensing a user input that is independent of said weight lifting force applied upon said exercise machine for activating said motor in a second mode to move said carriage in said second direction;

a monitor unit comprising a display device joined to said frame for at least monitoring said first mode and said second mode of said motor, and means for adjusting said first mode and said second mode to control a speed of said movement of said carriage; and a load cell joined to said frame and said drive unit for indicating a resisting force to said carriage movement and for transmitting said indication to said monitor unit for display on said display device.

16. The exercise machine as recited in claim 15, wherein said motor comprises a gear reduction box.

17. The exercise machine as recited in claim 15, wherein the exercise machine is wheelchair and paraplegic accessible.

18. The exercise machine as recited in claim 15, wherein said first portion is oriented generally horizontally.

19. The exercise machine as recited in claim 15, wherein said first portion is oriented generally vertically.

* * * * *